US005662534A

United States Patent [19]

Kroll et al.

[11] Patent Number: 5,662,534

[45] Date of Patent: Sep. 2, 1997

[54] GOLF BALL FINDING SYSTEM

[76] Inventors: Braden W. Kroll; Mark W. Kroll, both of 13011 Brenwood Trail, Minnetonka, Minn. 55343

[21] Appl. No.: 494,331

[22] Filed: Jun. 26, 1995

[51] Int. Cl.[6] ..... A63B 37/00; A63B 43/00

[52] U.S. Cl. ..... 473/353; 473/372

[58] Field of Search ..... 273/213, 187.3; 473/353, 407, 372

[56] References Cited

U.S. PATENT DOCUMENTS

| | | | |
|---|---|---|---|
| 2,861,810 | 11/1958 | Veatch | 473/353 |
| 5,150,895 | 9/1992 | Berger | 273/29 R |
| 5,423,549 | 6/1995 | Englmeier | 273/213 |

FOREIGN PATENT DOCUMENTS

| | | | |
|---|---|---|---|
| WO02768 | 4/1989 | Germany . | |
| 1172449 | 11/1969 | United Kingdom | 273/213 |
| 2188415 | 9/1981 | United Kingdom | 273/213 |

*Primary Examiner*—George J. Marlo

[57] ABSTRACT

A system and method for locating lost golf balls is taught. The system includes a special golf ball with an octant corner reflector resident within the center of the golf ball, as well as a convenient flashlight sized radar transmitter and receiver. The method teaches the use of such a portable handheld radar transmitter and receiver to sweep a golf course for evidence of an echo from the special golf ball with a resident reflector.

6 Claims, 6 Drawing Sheets

GOLF BALL FINDING SYSTEM

BACKGROUND OF THE INVENTION

The loss of a golf ball is a frustrating, time consuming and expensive problem for the beginner and intermediate golfer. Many golf courses have five minute time limits for searching to control the time delay. With golf balls costing at least $1.00 each, the expense can be considerable.

Some approaches have been suggested for the location of golf balls. One technique is to install an acoustical beeper within the golf ball. This was taught in Barnhill, U.S. Pat. No. 5,112,055. Unfortunately, due to the size of the golf ball, a sufficient acoustical level cannot be generated for the ball to be located over the typical necessary distance. Other approaches taught involve the coating of the golf ball with a fluorescent paint. Such an approach is taught in Gulick, U.S. Pat. No. 5,228,697. This may be useful for playing after dark but is not helpful during daylight hours which is when the vast majority of golf playing is done. A final approach involves placing a magnetic metal in the ball and using a metal detector (Valentino, U.S. Pat. No. 5,132,622). Unfortunately, metal detectors have extremely limited ranges.

The "Gopher" distributed by Minnesota Global, Inc. claims to locate golf balls by detecting ". . . the elements used in golf balls . . . " yet works, "just like a magnetic compass . . . ". There is no evidence (that these inventors are aware of) that the Gopher actually functions. The Gopher does demonstrate the commercial need for a golf ball locator, however.

A convenient and effective method has not been devised for locating golf balls.

SUMMARY OF THE INVENTION

BRIEF DESCRIPTION OF THE DRAWINGS AND DESCRIPTION OF THE PREFERRED EMBODIMENTS

Figure 1:
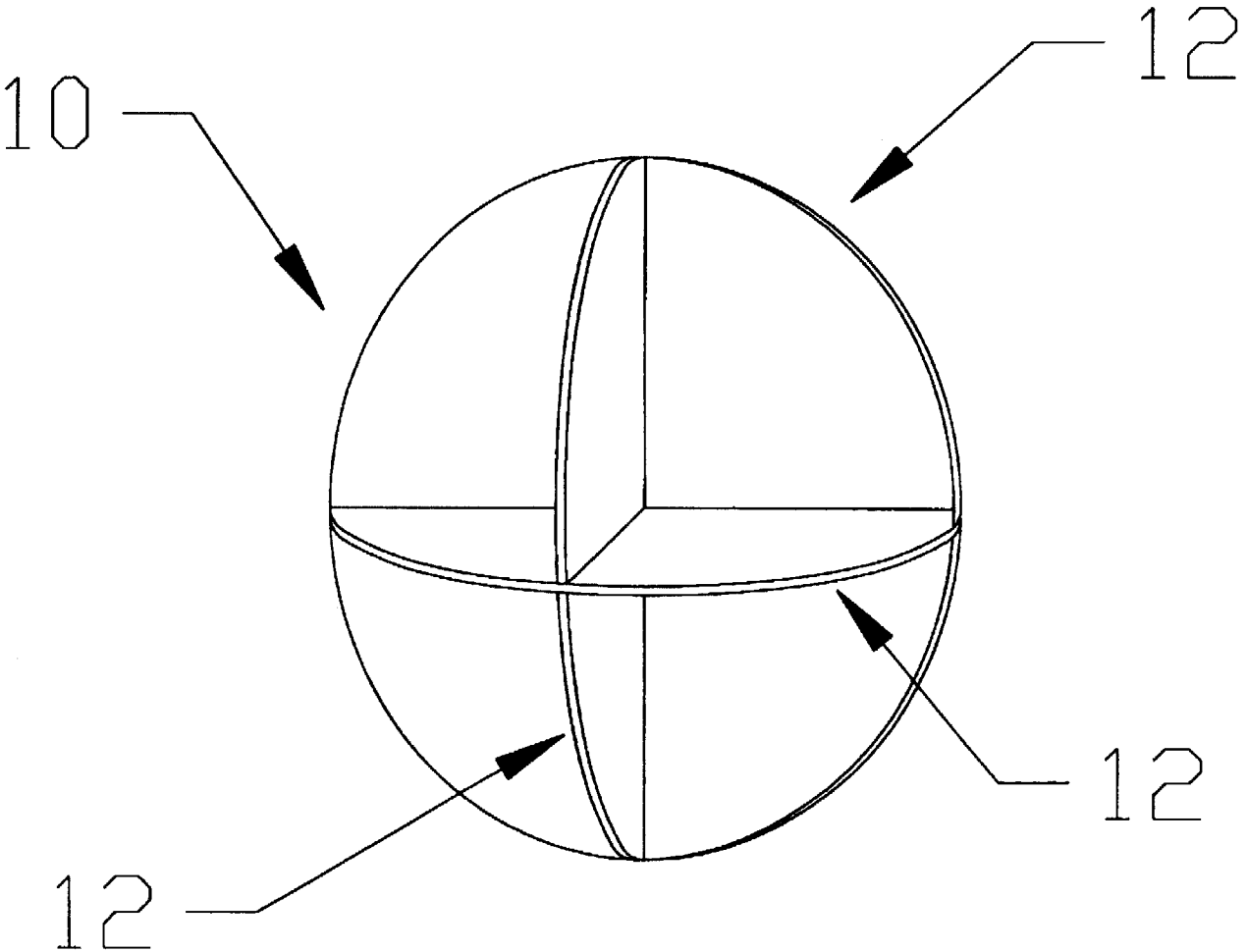

FIG. 1 shows the corner reflector.

This corner reflector 10 is composed of three circular discs 12 which are intersected at 90° angles. A microwave (radar) beam impinging on the corner reflector from any angle will be reflected directly back to the microwave source. (This is obvious if the beam directly hits one of the discs at a 90° angle.) But, because of the interaction of the three reflecting discs with each other, the multiple reflections will force any beam directly back to its original source.

There is a limitation in the frequency of the beam which will be reflected back. That is based on the fact that the wavelength of the beam must not be greater than the size of the reflector. Assuming a diameter of the reflector of 2 cm and the speed of light of $3\times10^{10}$ cm/sec, one can calculate that the minimum frequency is 15 GHz. The modem police K- band radar of 24.5 GHz meets this limit although even higher frequencies would have better reflectance capabilities.

Figure 2:
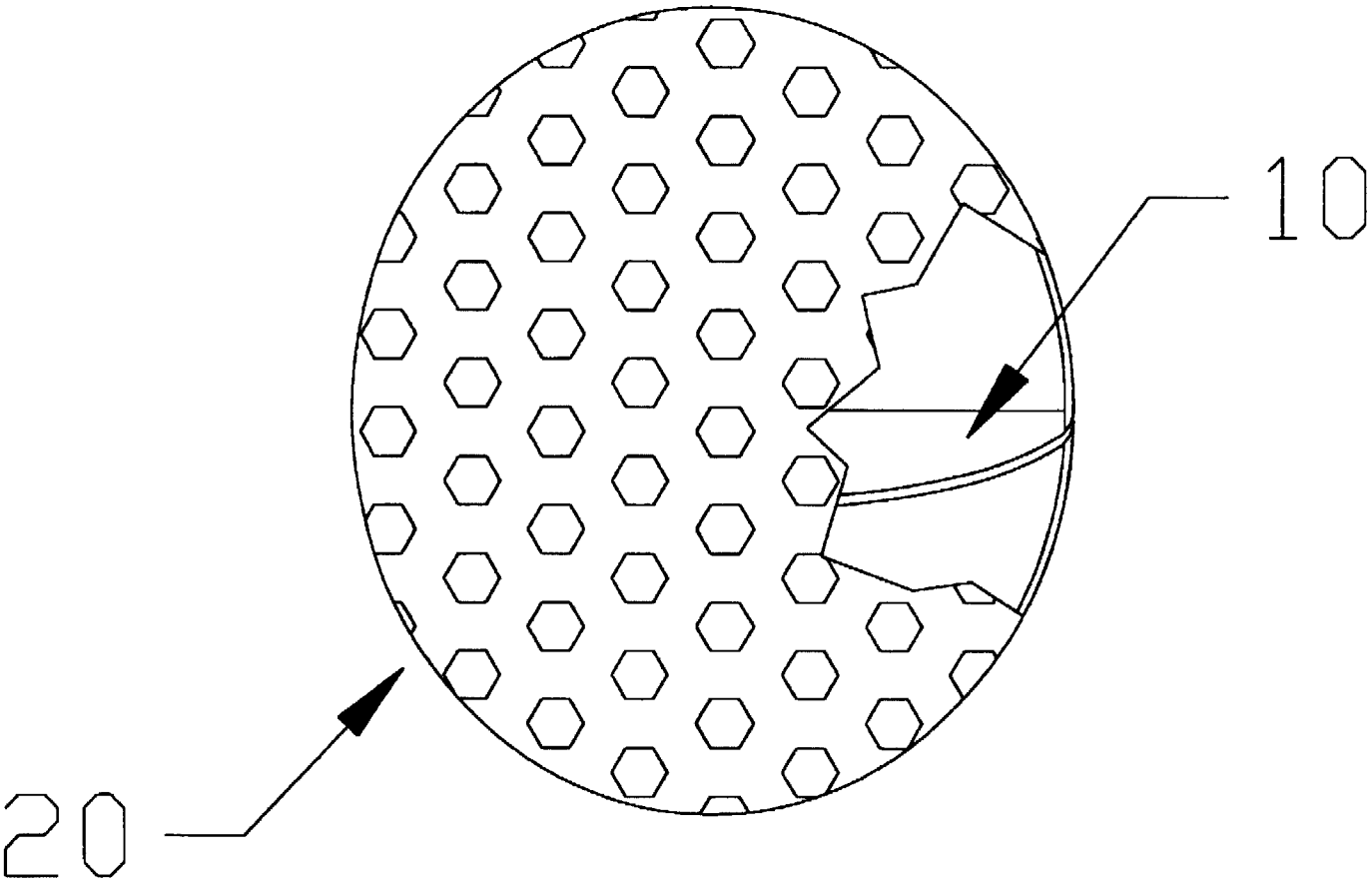

FIG. 2 shows a golf ball 20 with the octant corner reflector 10 resident within. Due to the high frequencies involved, the conductive material of the corner reflector can be extremely thin. It could be a very thin metal foil or, alternatively, it could be a plastic material with a metal merely vapor-deposited on it. Thus, the film could be made sufficiently flexible so that there would be no influence on the static or dynamic mechanical characteristics of the golf ball.

Figure 3:
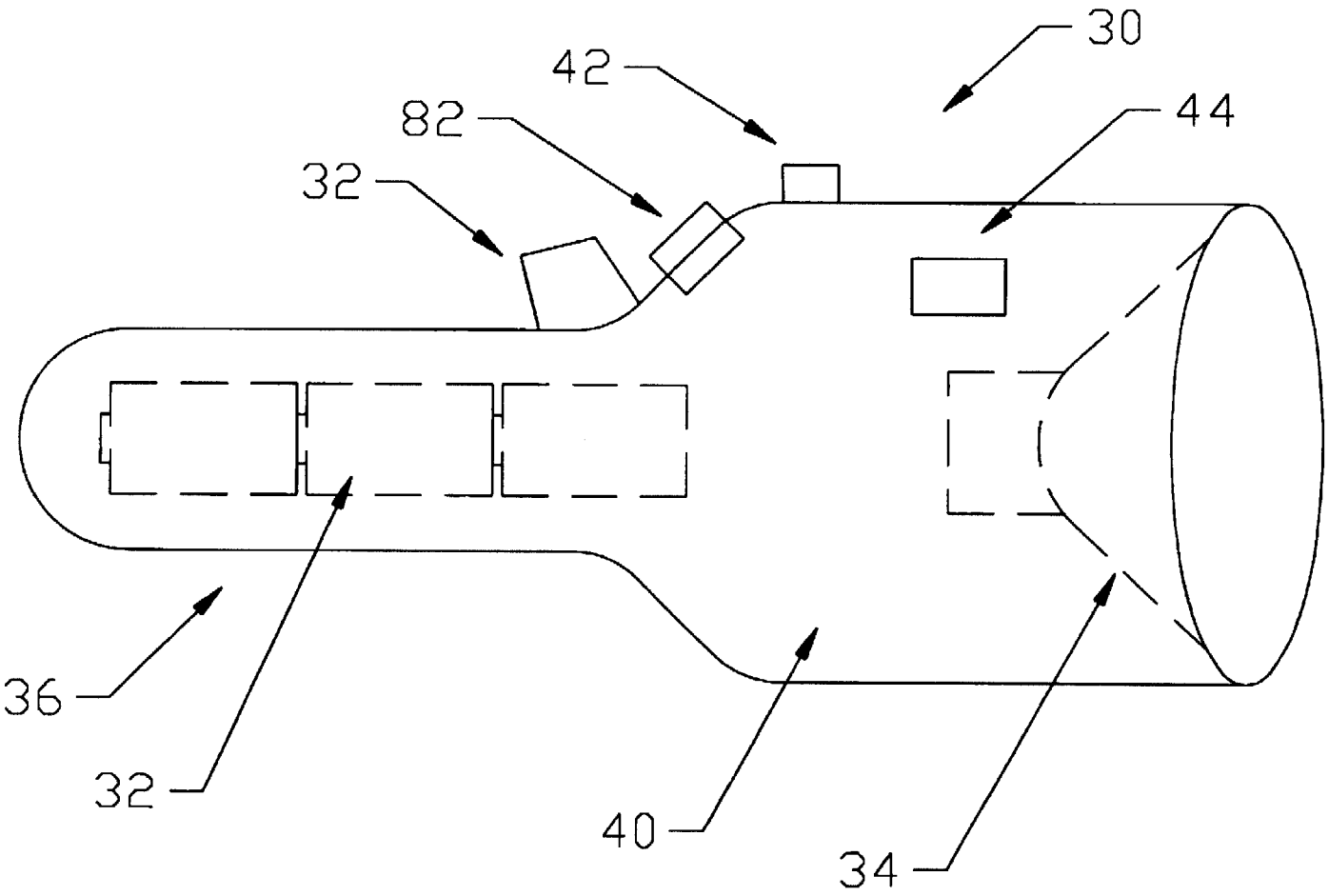

FIG. 3 shows a side view of the transponder device 30. A thumb activated momentary contact pushbutton switch 32 is used to turn the device on. The radar oscillator and antenna 34 is in the front of the device pointing forward. The device has a convenient handgrip 36 so that the golf player can operate it with one hand while carrying a golf bag in the other. A set of dry cells 38 is held in the handle, as is done with a flashlight. They power the electronics 40 which are located in the front of the device. An optional light emitting diode indicator 42 is on the top of a locator device. This is meant for use in quiet surroundings or where the golfer does not wish to disturb fellow golfers or draw attention to the fact that he may have lost a golf ball. A speaker 44 is built into the system permitting audible tones to guide the golfer. Digital number display 82 may be used to indicate the distance to the ball.

For a normal method of use, a golfer would depress thumbswitch 32 and sweep the locator from left to right until the most "positive" tone was heard. This could be the loudest tone. In other words, when the locator pointed directly at the golf ball, the highest volume of audio signal was generated. In the alternative, the electronics could be easily modified so that the most positive tone was a higher frequency tone, In other words, when the locator was pointed directly at the golf ball, the highest frequency was generated.

Figure 4:
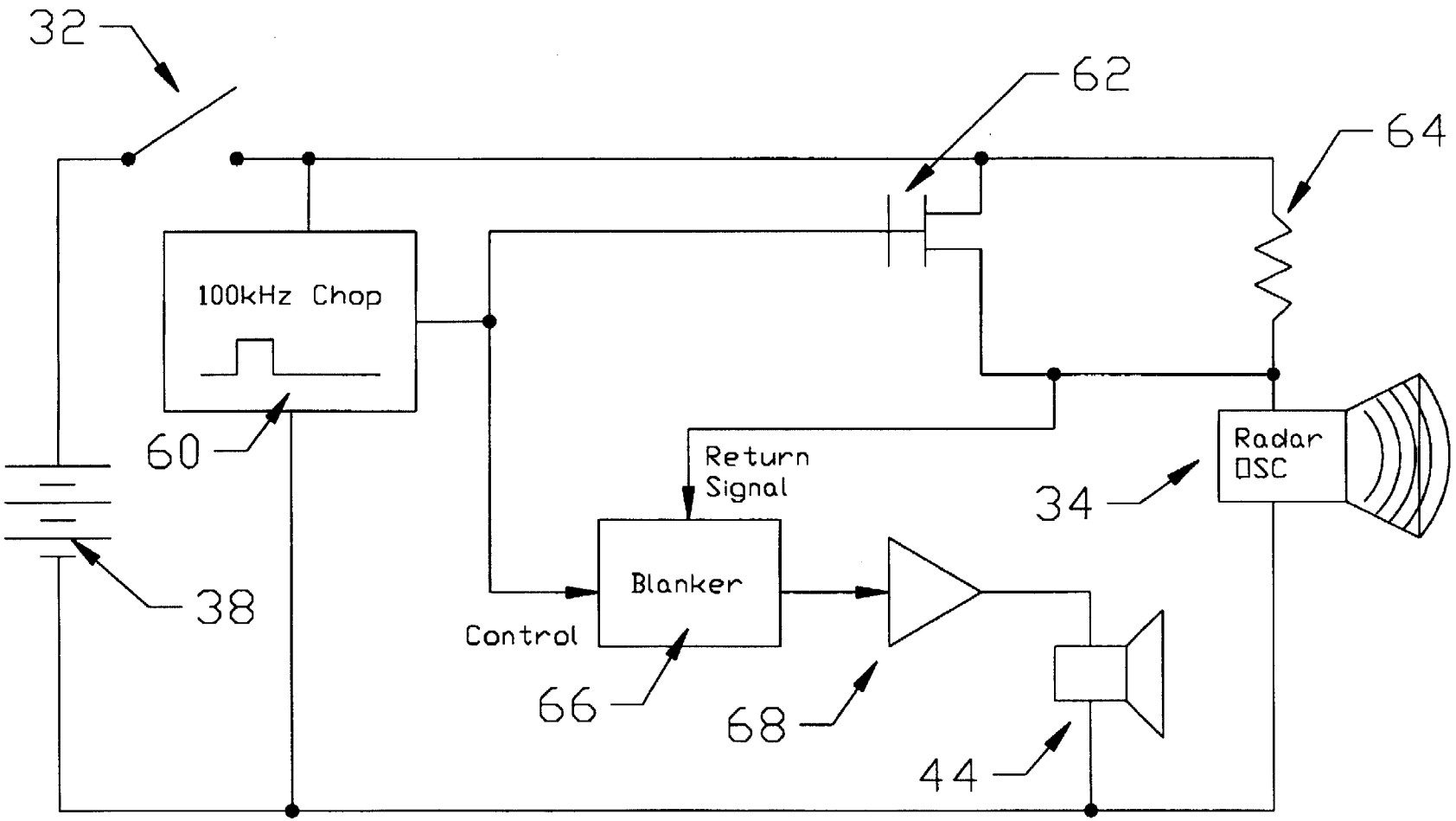

FIG. 4 shows the electronic schematic for the handle locator. Thumb activated pushbutton 32 allows the power from the battery pack 38 to flow into the circuitry. The high frequency switching oscillator 60 operates at a frequency of 100 kHz to generate a pulse of 1 μs with a spacing of about 10 μS. With the speed of light equalling $3\times10^{10}$ cm/sec, the 10 ms time allows the radar to travel out 500 ft. and back before the next radar pulse is emitted. The oscillator 60 controlls the gate of MOSFET switching transistor 62 which then controls the power oscillator 34 when the power is removed from the radar oscillator, a bias is maintained through resistor 64. This allows a signal to be received by the oscillator/antenna. This signal is run into the blanker 66. The blanker is controlled by the oscillator 60 so that it ignores the signals during the transmission time. These blanked signals are then fed to the amplifier 68 for amplification and processing. The signal from this amplifier is then fed to the speaker 44.

Figure 5:
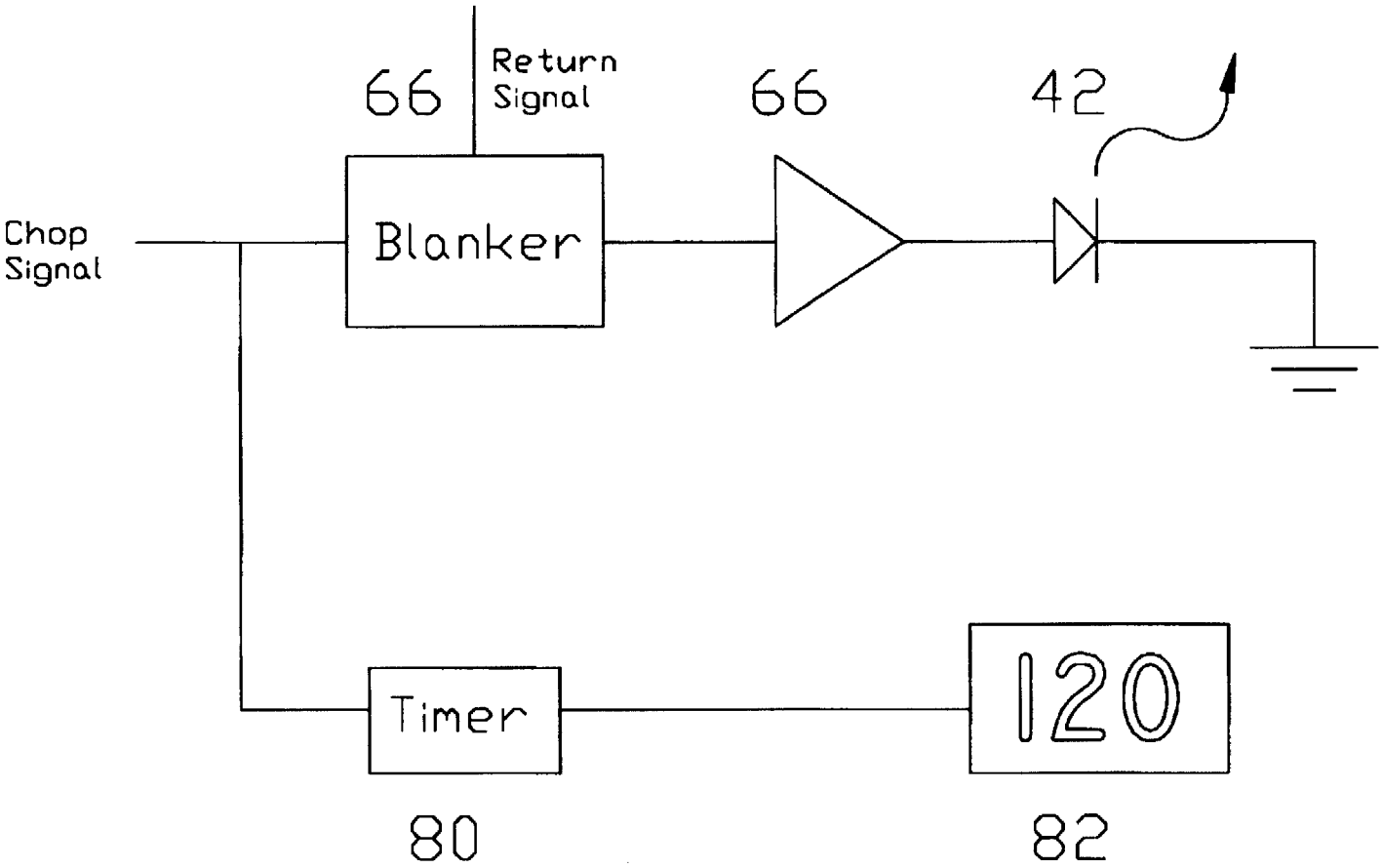

A further option is shown in FIG. 5. Here both the chopped signal and amplified blanked signal are fed into timer 80. This timer notes the number of microseconds since the transmission began and then calculates the distance to the reflection based on the speed of light. For example, if the time from the transmission to the first reflection was one microsecond, then a total flight path of the microwave beam would be known to be 100 ft. and since this includes the transmission out, as well as the return path, the locator could state that the golf ball was 50 ft. from it. This information is then displayed on numeric digital display 82.

As mentioned earlier, the immediate feedback signal could be given visually, in addition to as or in lieu of the audio signal. This visual signal would be generated by, for example, light emitting diode 42.

Any large piece of metal could cause a microwave reflection. Thus the distance measurement could be very helpful in discriminating these false echoes for the golfer. For example, if a strong echo was noticed by the locator, the golfer could note the distance to an echo. If that distance, for example, 240 ft., corresponded to a metal tank, the golfer would be advised to ignore that reflection and concentrate on another area.

Figure 6:
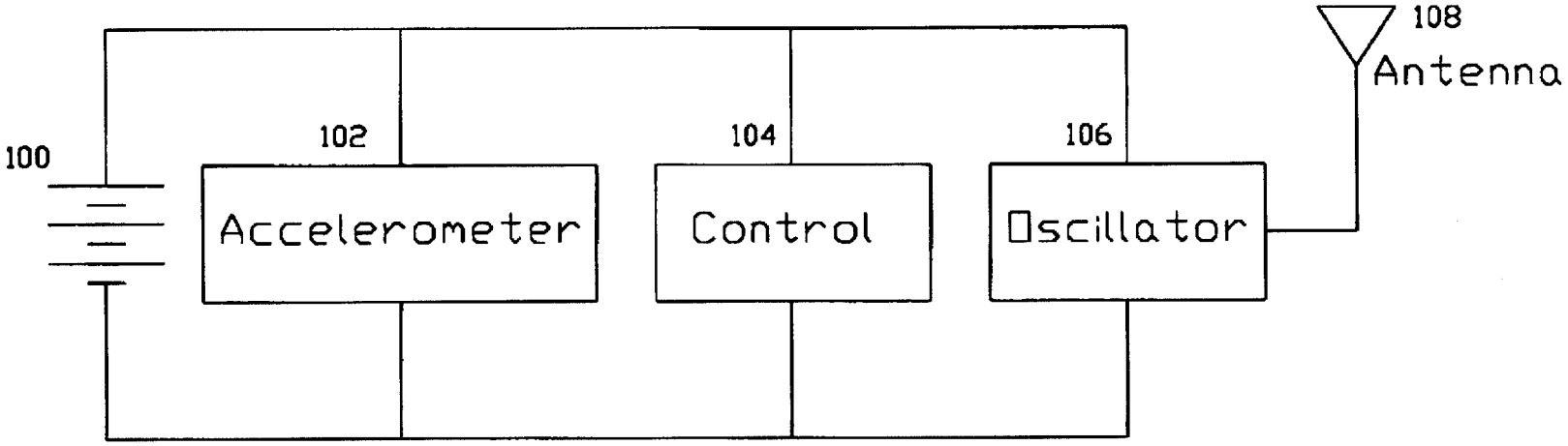

An alternative embodiment is shown in FIG. 6. Here the golf ball is an active (rather than passive reflective) source of the signal. A small battery 100 provides power to an accelerometer means 102. Upon the severe acceleration of the golf club hit, the accelerometer will generate a signal which is processed by control unit 104 to enable the oscillator 106 for a fixed period of time. The oscillator delivers its signal to antenna 108 for transmission to a portable detector.

We claim:

1. A system for finding lost golf balls comprising:

a golf ball with an internal corner reflector, a hand-held radar transponder communicating with the internal corner reflector, human detectable signaling means within the hand-held radar transponder, so that the system will signal to the human operator when the transponder is pointed at the golf ball.

2. The system of claim 1 in which the transponder signalling means is an audio output.

3. The system of claim 1 in which the transponder signaling means is visual.

4. The system of claim 1 in which the transponder contains an indication of the distance to the golf ball reflection.

5. The system of claim 1 in which the hand-held transponder transmits a radar signal to the corner reflector and receives a reflection from the corner reflector.

6. The system of claim 5 in which the hand-held transponder calculates the distance from the transponder to the golf ball from the time elapsed from the transmission to the reflection.

* * * * *